US005916261A

United States Patent [19]

Bonaquist et al.

[11] Patent Number: 5,916,261

[45] Date of Patent: Jun. 29, 1999

[54] CRYOGENIC ARGON PRODUCTION SYSTEM WITH THERMALLY INTEGRATED STRIPPING COLUMN

[75] Inventors: Dante Patrick Bonaquist, Grand Island; Nancy Jean Lynch, North Tonawanda, both of N.Y.; Mark Julian Roberts, Nazareth, Pa.

[73] Assignee: Praxair Technology, Inc., Danbury, Conn.

[21] Appl. No.: 09/053,751

[22] Filed: Apr. 2, 1998

[51] Int. Cl.[6] ..... F25J 3/04

[52] U.S. Cl. ..... 62/643; 62/924

[58] Field of Search ..... 62/643, 924

[56] References Cited

U.S. PATENT DOCUMENTS 5,019,144 5/1991 Victor et al. .
5,019,145 5/1991 Rohde et al. .
5,049,174 9/1991 Thorogood et al. ..... 62/924 X
5,114,449 5/1992 Agrawal et al. .
5,133,790 7/1992 Bianchi et al. .
5,313,800 5/1994 Howard et al. .
5,469,710 11/1995 Howard et al. .
5,572,874 11/1996 Rathbone ..... 62/645
5,682,765 11/1997 Lynch et al. ..... 62/646

FOREIGN PATENT DOCUMENTS 1048936 1/1959 Germany .

*Primary Examiner*—Christopher B. Kilner
*Attorney, Agent, or Firm*—Stanley Ktorides

[57] ABSTRACT

A cryogenic rectification system for producing argon employing an argon stripping column which receives a feed in its upper portion from an associated cryogenic air separation plant, and which is reboiled by another fluid taken from the cryogenic air separation plant.

6 Claims, 2 Drawing Sheets

CRYOGENIC ARGON PRODUCTION SYSTEM WITH THERMALLY INTEGRATED STRIPPING COLUMN

TECHNICAL FIELD

This invention relates generally to cryogenic rectification and, more particularly, to cryogenic rectification for the production of argon.

BACKGROUND ART

Argon has become an increasingly important component in the metallurgical industry. Argon degassing of stainless and specialty steels is an example of the application of argon in the iron and steel industry. Argon is also used extensively in the cutting and welding of various metals. The development of the plasma jet torch has permitted the use of argon mixtures heated to very high temperatures to be used for cutting operations and for coating metals with refractory materials. More recently argon has become an important ingredient in the electronics industry as a carrier, purge, or blanketing gas to exclude air from certain processes, especially in growing crystals, ion milling, and other etching processes.

Argon is generally produced using an argon sidearm column which receives a feed stream from the lower pressure column of a double column cryogenic air separation plant. This arrangement enables the production of a crude argon product which is then passed through a deoxo unit to produce high purity argon.

A recent advancement in the field of argon production has been the use of a superstaged argon sidearm column which can produce high purity argon without the need for processing through a deoxo unit. However, such a superstaged sidearm column is expensive to build and to maintain.

Accordingly, it is an object of this invention to provide a cryogenic rectification system for the production of argon which can produce relatively high purity argon without the need for a superstaged argon sidearm column.

SUMMARY OF THE INVENTION

The above and other objects, which will become apparent to those skilled in the art upon a reading of this disclosure, are attained by the present invention, one aspect of which is:

A method for producing argon comprising:

(A) introducing feed air into a cryogenic air separation plant and producing by cryogenic rectification within the cryogenic air separation plant a fluid comprising nitrogen and argon;

(B) passing said fluid comprising nitrogen and argon from the cryogenic air separation plant into the upper portion of an argon stripping column as argon stripping column feed;

(C) passing argon stripping column feed down the argon stripping column against upflowing vapor and producing nitrogen-richer fluid in the upper portion of the argon stripping column and argon-richer fluid in the lower portion of the argon stripping column;

(D) vaporizing a portion of the argon-richer fluid by indirect heat exchange with reboiling fluid taken from the cryogenic air separation plant to produce said upflowing vapor; and (E) recovering another portion of the argon-richer fluid from the lower portion of the argon-stripping column as product argon.

Another aspect of the invention is:

Apparatus for producing argon comprising:

(A) a cryogenic air separation plant and means for passing feed air into the cryogenic air separation plant;

(B) an argon stripping column having a bottom reboiler;

(C) means for passing fluid from the cryogenic air separation plant into the upper portion of the argon stripping column;

(D) means for passing fluid from the cryogenic air separation plant to the bottom reboiler and from the bottom reboiler to the cryogenic air separation plant; and (E) means for recovering product argon from the lower portion of the argon stripping column.

As used herein, the term "feed air" means a mixture comprising primarily oxygen, nitrogen and argon, such as ambient air.

As used herein, the term "column" means a distillation or fractionation column or zone, i.e. a contacting column or zone, wherein liquid and vapor phases are countercurrently contacted to effect separation of a fluid mixture, as, for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term "double column", is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the terms "upper portion" and "lower portion" mean those sections of a column respectively above and below the mid point of the column.

As used herein, the term "stripping column" means column operated with sufficient vapor upflow relative to liquid downflow to achieve separation of a volatile component from the liquid into the vapor in which the volatile component becomes progressively richer upwardly.

As used herein, the term "cryogenic air separation plant" means a plant, comprising at least one column, which processes feed air and produces at least one of product nitrogen and product oxygen.

DETAILED DESCRIPTION OF THE DRAWINGS

DETAILED DESCRIPTION

The invention employs an argon stripping column which processes a feed comprising argon and nitrogen with very little oxygen from the cryogenic air separation plant. The argon stripping column is thermally integrated with the cryogenic air separation plant wherein vapor from the cryogenic air separation plant reboils the argon stripping column to generate upflowing vapor to strip off nitrogen from the descending argon stripping column feed, thus producing argon, which is relatively free of both oxygen and nitrogen, at the bottom of the argon striping column. The invention will be described in greater detail with reference to the Drawings.

Figure 1:
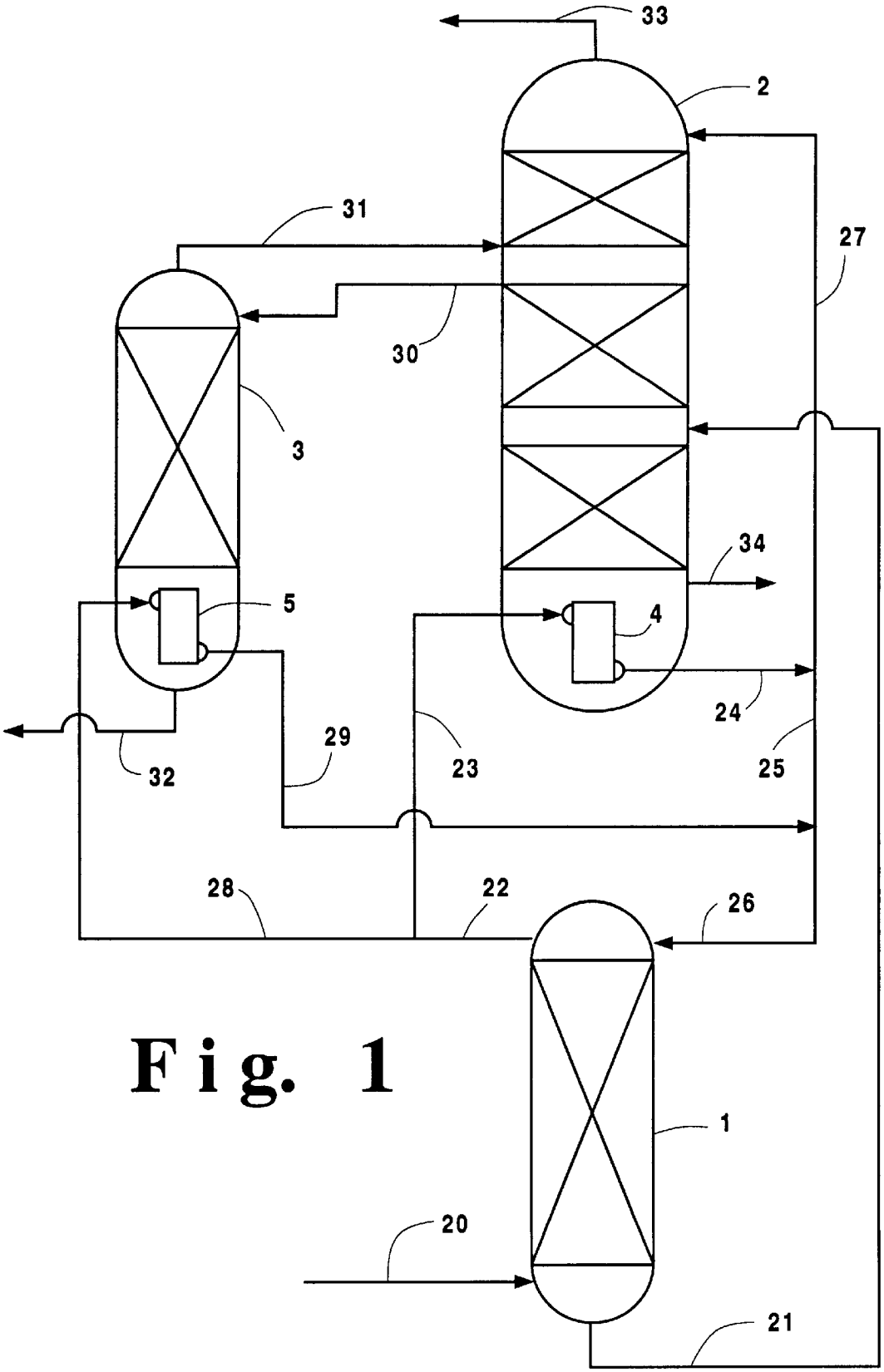
FIG. 1 is a schematic flow diagram of one preferred embodiment of the invention wherein the cryogenic air separation plant is a double column and the argon stripping column is reboiled using vapor from the higher pressure column of the double column.

Referring now to FIG. 1, feed air 20, which has been compressed, cooled and cleaned of high boiling impurities such as carbon dioxide, water vapor and hydrocarbons, is introduced into a cryogenic air separation plant. In the embodiment of the invention illustrated in FIG. 1, the cryogenic air separation plant is a double column plant comprising higher pressure column 1 and lower pressure column 2. Feed air 20 is passed into the lower portion of first or higher pressure column 1 which is operating at a pressure generally within the range of from 70 to 90 pounds per square inch absolute (psia).

Within higher pressure column 1 the feed air is separated by cryogenic rectification into nitrogen-enriched vapor and oxygen-enriched liquid. The oxygen-enriched liquid is passed from the lower portion of higher pressure column 1 in stream 21 into second or lower pressure column 2. Nitrogen-enriched vapor is withdrawn from the upper portion of higher pressure column 1 in stream 22. A portion 23 of stream 22 is passed into bottom reboiler 4 of lower pressure column 2 wherein it is condensed by indirect heat exchange against lower pressure column bottom liquid. Resulting nitrogen-enriched liquid 24 is divided into a portion 27, which is passed into the upper portion of lower pressure column 2 as reflux, and into a portion 25 which is passed into the upper portion of higher pressure column 1 as reflux.

In the embodiment of the invention illustrated in FIG. 1, another portion 28 of nitrogen-enriched vapor stream 22 is passed as reboiling fluid into bottom reboiler 5 of argon stripping column 3 wherein it is condensed by indirect heat exchange with argon-richer fluid as will be described in greater detail below. Resulting nitrogen-enriched liquid 29 is combined with stream 25 to form stream 26 for passage into higher pressure column 1 as reflux.

Lower pressure column 2 is operating at a pressure less than that of higher pressure column 1 and generally within the range of from 17 to 25 psia. Within lower pressure column 2 the feeds into the column are separated by cryogenic rectification into nitrogen-rich vapor and oxygen-rich fluid. Nitrogen-rich vapor is withdrawn from the upper portion of lower pressure column 2 in stream 33 which may be recovered as product nitrogen having a nitrogen concentration of at least 99 mole percent. Oxygen-rich fluid, having an oxygen concentration of at least 99 mole percent, is withdrawn as liquid and/or vapor from the lower portion of lower pressure column 2 and may be recovered as product. FIG. 1 illustrates an embodiment wherein the oxygen-rich fluid is withdrawn from lower pressure column 2 as vapor stream 34. The oxygen-rich fluid may also be withdrawn from lower pressure column 2 as liquid, pumped to a higher pressure, vaporized, and recovered as elevated pressure oxygen gas product.

A fluid comprising mostly nitrogen and argon with very little oxygen is withdrawn from the upper portion of lower pressure column 2 in stream 30 and passed into the upper portion of argon stripping column 3 as argon stripping column feed. Preferably, as illustrated in FIG. 1, liquid stream 30 is passed into the top of argon stripping column 3. Argon stripping column feed 30 has a nitrogen concentration within the range of from 40 to 90 mole percent, an argon concentration within the range of from 10 to 60 mole percent, and an oxygen concentration not more than 1 mole percent. The argon stripping column feed passes as liquid down argon stripping column 3 against upflowing vapor and in the process nitrogen within the downflowing liquid passes into the upflowing vapor, and argon within the upflowing vapor passes into the downflowing liquid, resulting in the production of nitrogen-richer vapor in the upper portion of argon stripping column 3 and argon-richer liquid in the lower portion of argon stripping column 3. A portion of the argon-richer liquid is vaporized by indirect heat exchange with the aforesaid condensing nitrogen-enriched vapor in stream 28 to generate the upflowing vapor used to carry out the stripping action within argon stripping column 3.

Nitrogen-richer vapor, having a nitrogen concentration which exceeds that of the argon stripping column feed and generally within the range of from 70 to 95 mole percent, is withdrawn from the upper portion of argon stripping column 3 and, preferably as illustrated in FIG. 1, passed into the upper portion of lower pressure column 2 in stream 31. Argon-richer fluid, having an argon concentration of at least 97 mole percent and generally within the range of from 98 to 99.9 mole percent, is recovered from the lower portion of argon stripping column 3. In the embodiment of the invention illustrated in FIG. 1, the argon-richer fluid is recovered as liquid in stream 32.

Figure 2:
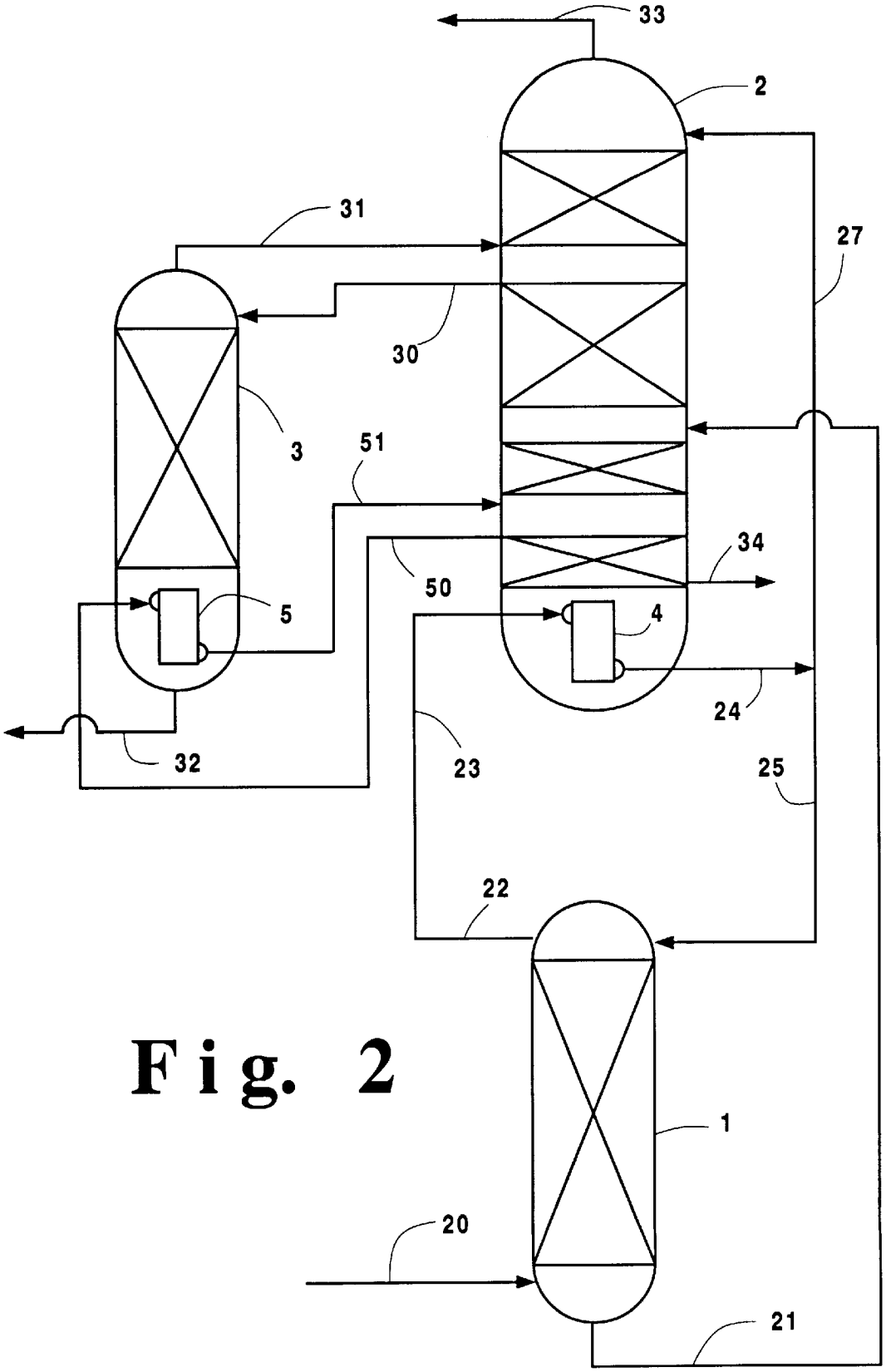
FIG. 2 is a schematic flow diagram of another preferred embodiment of the invention wherein the cryogenic air separation plant is a double column and the argon stripping column is reboiled using vapor from the lower pressure column of the double column.

FIG. 2 illustrates another embodiment of the invention wherein the argon stripping column is reboiled by fluid taken from the lower pressure column. The numerals in FIG. 2 correspond to those of FIG. 1 for the common elements and the common elements will not be described again in detail.

Referring now to FIG. 2, all of nitrogen-enriched vapor stream 22 is passed to bottom reboiler 4. A vapor stream 50 having an oxygen concentration generally within the range of from 75 to 99.5 mole percent and a nitrogen concentration within the range of from 0 to 10 mole percent, is withdrawn from the lower portion of lower pressure column 2 but from above bottom reboiler 4, and passed as reboiling fluid into argon stripping column bottom reboiler 5 wherein it is condensed by indirect heat exchange with argon-richer liquid to generate upflowing vapor for argon stripping column 3. Resulting condensed fluid 51 is returned to the lower portion of lower pressure column 2.

Now with the practice of this invention one can produce relatively high purity argon without need for a superstaged argon sidearm argon. Conventional argon sidearm column practice processes a feed comprising primarily oxygen and argon which have relatively similar volatilities. In the practice of the invention, the argon stripping column processes a feed comprising primarily nitrogen and argon which have relatively different volatilities. Especially at the typical operating pressures of the argon stripping column, generally within the range of from 18 to 20 psia, these relatively different volatilities enable the very high separation of the components without the need for an excessive number of separation stages.

Although the invention has been described in detail with reference to certain preferred embodiments, those skilled in the art will recognize that there are other embodiments of the invention within the spirit and the scope of the claims.

We claim:

1. A method for producing argon comprising:

(A) introducing feed air into a double column cryogenic air separation plant comprising a higher pressure column and a lower pressure column, and producing by cryogenic rectification within the cryogenic air separation plant a fluid comprising nitrogen and argon;

(B) passing said fluid comprising nitrogen and argon from the lower pressure column of the cryogenic air separation plant into the upper portion of an argon stripping column as argon stripping column feed;

(C) passing argon stripping column feed down the argon stripping column against upflowing vapor and producing nitrogen-richer fluid in the upper portion of the argon stripping column and argon-richer fluid in the lower portion of the argon stripping column;

(D) vaporizing a portion of the argon-richer fluid by indirect heat exchange with reboiling fluid taken from the cryogenic air separation plant to produce said upflowing vapor; and (E) recovering another portion of the argon-richer fluid from the lower portion of the argon stripping column as product argon.

2. The method of claim 1 wherein the reboiling fluid is taken from the higher pressure column of the cryogenic air separation plant.

3. The method of claim 1 wherein the reboiling fluid is taken from the lower pressure column of the cryogenic air separation plant.

4. Apparatus for producing argon comprising:

(A) a double column cryogenic air separation plant comprising a higher pressure column and a lower pressure column; and means for passing feed air into the cryogenic air separation plant;

(B) an argon stripping column having a bottom reboiler;

(C) means for passing fluid from the lower pressure column of the cryogenic air separation plant into the upper portion of the argon stripping column;

(D) means for passing fluid from the cryogenic air separation plant to the bottom reboiler and from the bottom reboiler to the cryogenic air separation plant; and (E) means for recovering product argon from the lower portion of the argon stripping column.

5. The apparatus of claim 4 wherein the means for passing fluid from the cryogenic air separation plant to the bottom reboiler communicates with the higher pressure column.

6. The apparatus of claim 4 wherein the means for passing fluid from the cryogenic air separation plant to the bottom reboiler communicates with the lower pressure column.

* * * * *